US009605632B1

(12) United States Patent
Leffler

(10) Patent No.: US 9,605,632 B1
(45) Date of Patent: Mar. 28, 2017

(54) ACOUSTIC RESONATOR HAVING A PARTITIONED NECK

(71) Applicant: Mann+Hummel GMBH, Ludwigsburg (DE)

(72) Inventor: Joe Leffler, Mattawan, MI (US)

(73) Assignee: MANN+HUMMEL GMBH, Ludwigsburg (DE)

( * ) Notice: Subject to any disclaimer, the term of this patent is extended or adjusted under 35 U.S.C. 154(b) by 0 days.

(21) Appl. No.: 15/041,140

(22) Filed: Feb. 11, 2016

(51) Int. Cl.
*F02M 35/12* (2006.01)

(52) U.S. Cl.
CPC ..... *F02M 35/1261* (2013.01)

(58) Field of Classification Search
CPC ..... F02M 35/1261
USPC ..... 181/229, 236
See application file for complete search history.

(56) References Cited

U.S. PATENT DOCUMENTS 5,475,189 A * 12/1995 Field ..... F16L 55/0333 181/229
6,698,390 B1 * 3/2004 Kostun ..... F02M 35/1222 123/184.57
7,089,901 B2 * 8/2006 Kino ..... F02M 35/1261 123/184.57
7,117,974 B2 * 10/2006 Moenssen ..... F02M 35/1216 123/184.55
2004/0250785 A1 * 12/2004 Oba ..... F02M 35/08 123/184.57
2012/0181107 A1 * 7/2012 Hwang ..... F02M 35/1266 181/229

FOREIGN PATENT DOCUMENTS

JP 05240120 A * 9/1993

* cited by examiner

*Primary Examiner* — Forrest M Phillips
(74) *Attorney, Agent, or Firm* — James Hasselbeck

(57) ABSTRACT

A resonator for attenuating sound waves produced by an engine includes a resonator housing and a neck. The neck includes an outer shell extending from the resonator housing providing fluid communication between the resonator housing and an air duct. The neck further includes a partition disposed in the outer shell. The partition cooperates with the outer shell to define a plurality of distinct air paths, each air path in fluid communication with a distinct resonance chamber of the plurality of resonance chambers. The resonator is operable to attenuate or change the characteristics of sound waves produced by the engine.

13 Claims, 3 Drawing Sheets

ACOUSTIC RESONATOR HAVING A PARTITIONED NECK

TECHNICAL FIELD

The present disclosure generally relates to acoustic resonators. More particularly, the present disclosure relates to an acoustic resonator of an air induction system that attenuates sound waves produced by an engine. In one particular application, the present disclosure relates to an acoustic resonator having a partitioned neck.

BACKGROUND OF THE INVENTION

This section provides background information related to the present disclosure which is not necessarily prior art.

Air induction systems are used in motor vehicles and for other applications to transport air from the environment to an engine for combustion. As air moves through the air induction system and into the engine, noise and vibration from the engine may be transmitted and amplified by the passages forming the air induction system. In order to reduce the volume or amplitude of air pulsations that may particularly correspond to the opening and closing of engine air intake valves and other characteristics of these noises, it may be desirable to utilize a resonator that is configured to resonate at and reflect sound waves at one or more frequencies related to the undesirable noise so as to modify the sound characteristics of the air induction system. In this manner, sound waves may be produced that attenuate or reduce the sound waves produced by the engine.

In some situations, it may be desirable to provide a resonator that effectively responds to more than one sound wave, including the frequency thereof, produced by the engine. For example, when the engine is running at low RPM, it may be desirable to have a low frequency resonator to effectively suppress, or in some cases enhance the amplitude of low frequency sound waves produced by the engine. When the engine is running at high RPM, it may be desirable to have a high frequency resonator to effectively suppress the sound waves produced by the engine. It is known that some frequencies may be experienced as more unpleasant to the human hearing, while other frequencies, in some cases lower frequencies, may enhance the experience of engine power and performance.

Different types of resonators have been used for automotive and related applications. According to one known type of acoustic resonator, a tube in communication with an engine may extend into an air filter box housing. In certain known arrangements, multiple necks originating from separate ports on a clean side duct may terminate at corresponding chambers within a resonator housing. The sound produced by the engine may also be attenuated by adjusting a neck area of the tube.

While known resonators have generally proven to be acceptable for their intended purposes, a continued need in the relevant art remains. In this regard, packaging considerations may restrict the application of conventional manners of sound attenuation.

SUMMARY OF THE INVENTION

This section provides a general summary of the disclosure, and is not a comprehensive disclosure of its full scope or all of its features.

According to one particular aspect, the present disclosure provides a resonator for attenuating sound waves produced by an engine. The resonator includes a resonator housing and a neck. The neck includes an outer shell extending from the resonator housing providing fluid communication between the resonator housing and an air duct. The neck further includes a partition disposed in the outer shell. The partition cooperates with the outer shell to define a plurality of distinct air paths, each air path in fluid communication with a distinct resonance chamber of the plurality of resonance chambers. The resonator is operable to attenuate or modify the sound characteristics of sound waves by the superposition of sound waves reflected by the resonator onto those produced by the engine.

According to another particular aspect, the present disclosure provides an air induction system for attenuating sound waves produced by an engine. The air induction system may include an air duct, a resonator and a common neck. The resonator housing includes a plurality of resonance chambers. The common neck defines a corresponding plurality of distinct air paths between the air duct and the plurality of resonance chambers.

According to yet another particular aspect, the present disclosure provides a method of attenuating sound waves produced by an engine. The method may include providing a resonator in fluid communication with an air duct for delivering a source of intake air to the engine. The resonator may have a plurality of resonance chambers. The method may additionally include partitioning a common neck of the resonator to define a corresponding plurality of distinct air paths between the air duct and the plurality of resonance chambers and attenuating sound waves produced by the engine having a first dominant frequency with a first air path of the plurality of distinct air paths and a first working chamber of the plurality of resonance chambers. The method may further include attenuating sound waves produced by the engine having a second dominant frequency with a second air path of the plurality of distinct air paths and a second working chamber of the plurality of resonance chambers.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
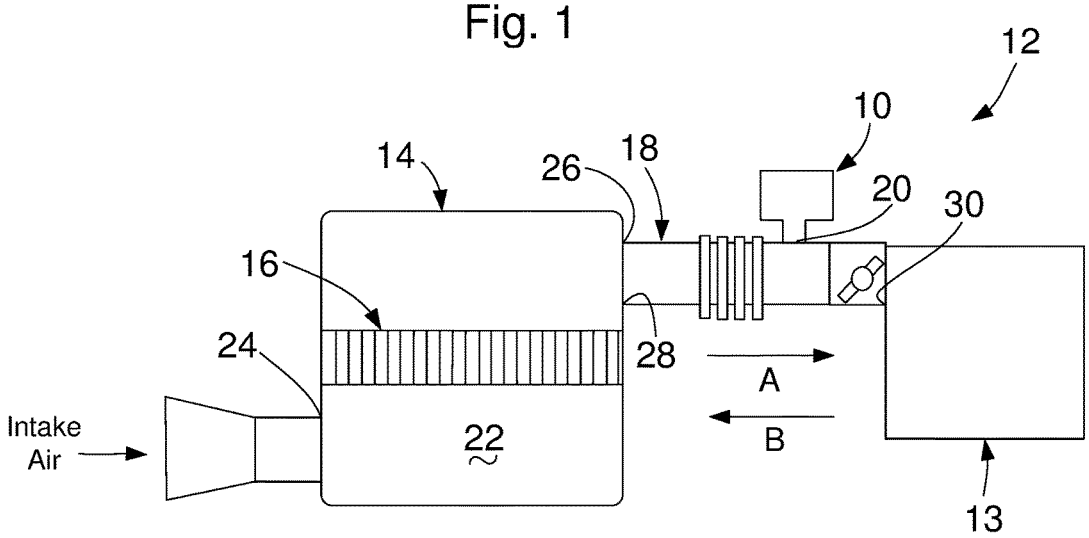
FIG. 1 is a simplified view of an air induction system including a resonator in accordance with the teachings of the present disclosure, the air induction system shown operatively associated with a source of intake air and a vehicle engine.
Figure 2:
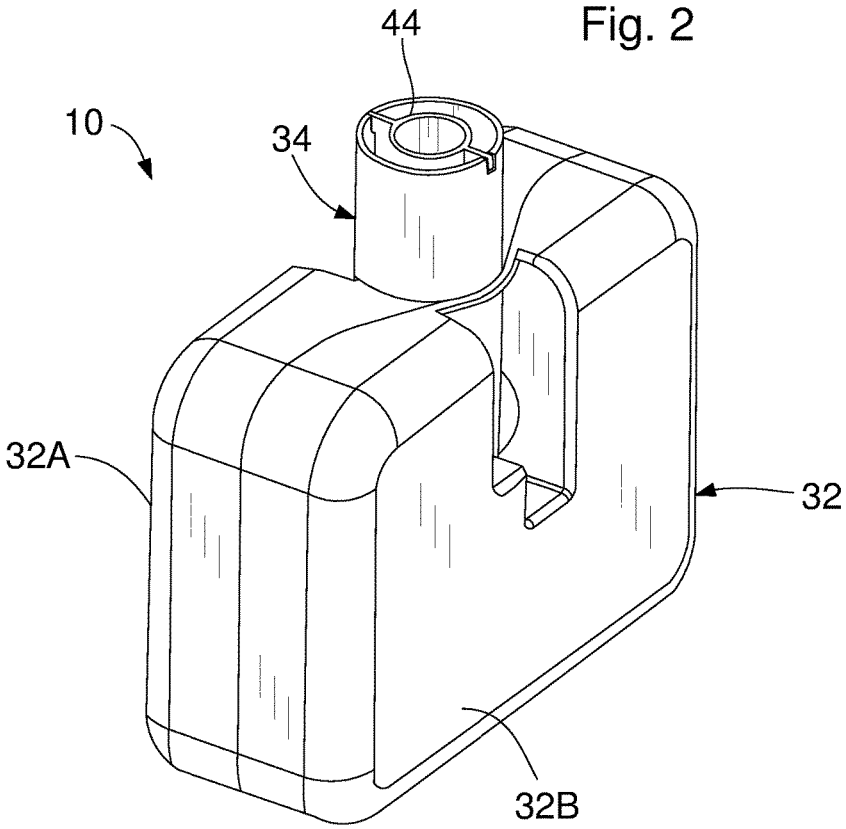
FIG. 2 is a perspective view of a resonator in accordance with the present teachings.
Figure 4:
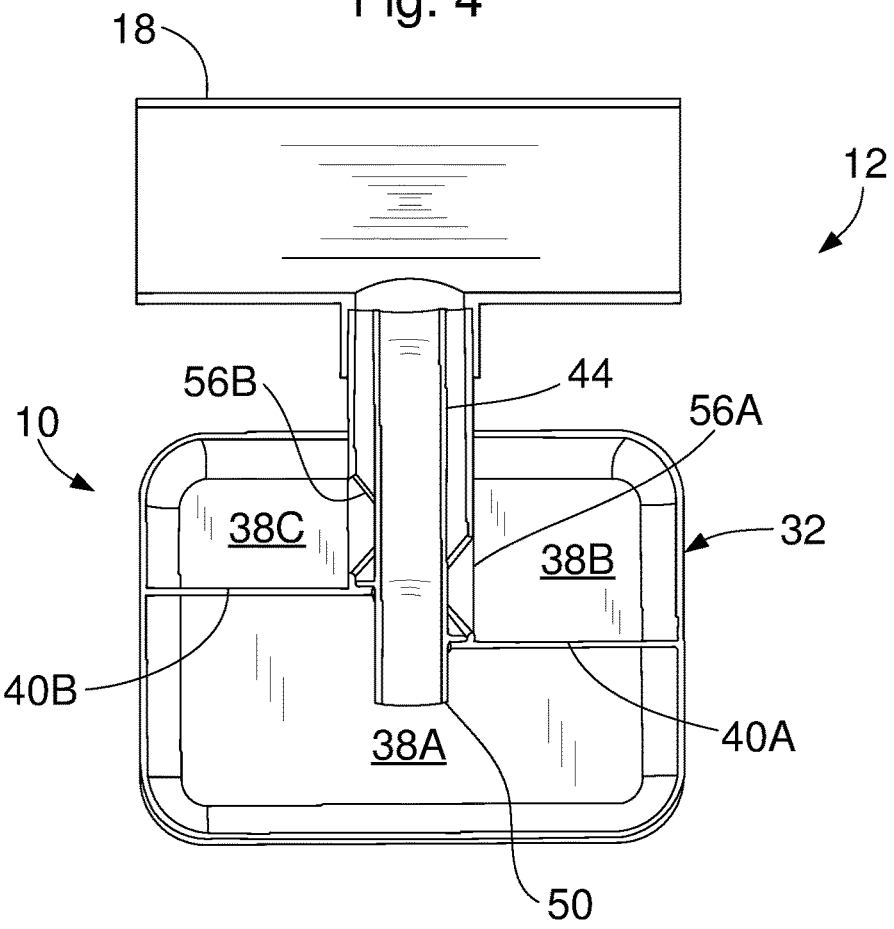

FIG. 4 a cross-sectional view taken through a portion of the air induction system of FIG. 1.

Figure 5:
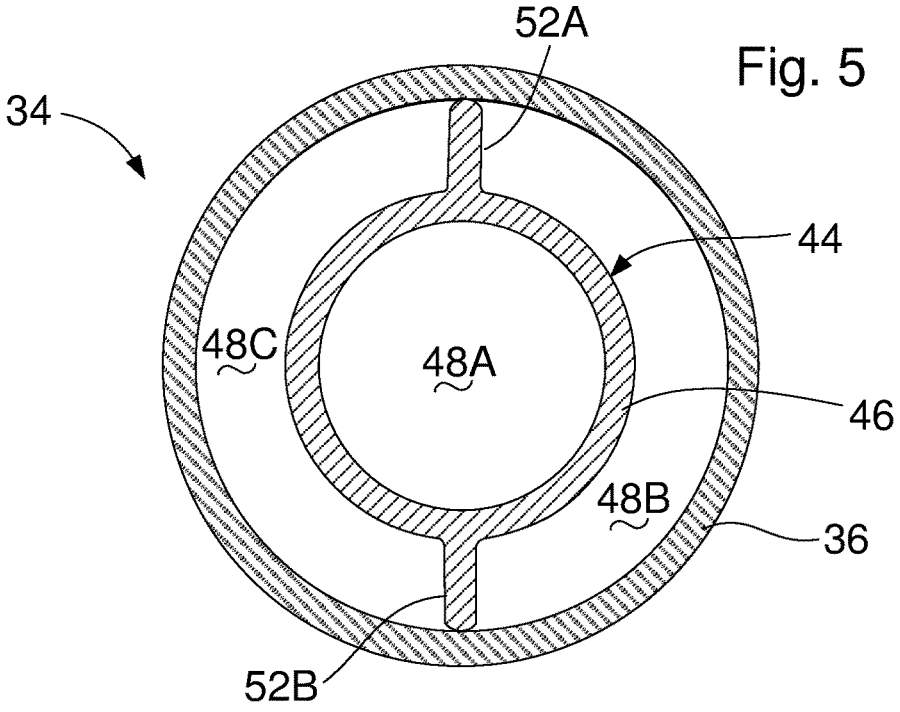

FIG. 5 is a cross-sectional view taken through a neck of a resonator in accordance with the present teachings.

Corresponding reference numerals indicate corresponding parts throughout the several views of the drawings.

DETAILED DESCRIPTION OF INVENTION

Example embodiments will now be described more fully with reference to the accompanying drawings.

With initial reference to FIG. 1, a resonator constructed in accordance with the present teachings is illustrated and identified at reference character 10. The resonator 10 is shown operatively incorporated into an air induction system 12. The air induction system 12 may be used to transport and filter air from and between the environment and an engine 13 or other device utilizing a flow of air. As will be described in more detail below, the resonator 10 may be used to attenuate sound waves produced by the engine 13. By way of example only, the resonator 10 may be used to dampen, shift the frequencies of or in some cases cancel out or otherwise tune sound waves produced by the engine 13 or other noise-producing apparatus.

Before addressing the details and operation of the resonator 10 of the present teachings, a brief understanding of other elements of the air induction system 12 is warranted. Insofar as the present invention is concerned, the construction and operation of these other elements will be understood to be conventional to the extent not otherwise described herein.

As shown in FIG. 1, the air induction system 12 may generally include an air filter housing 14, an air filter 16 in the air filter housing 14, the resonator 10 and a conduit or duct 18. Air from the environment may generally travel through the air induction system 12 to the engine 13 by passing through the air filter 16 and the duct 18. As the air passes through the air filter housing 14, the air is filtered by the air filter 16. As the air passes through the duct 18 from the air filter housing 14 to the engine 13, the air passes across an input port 20 leading to the resonator 10.

In the embodiment illustrated, the engine 13 may be an internal combustion engine for a motor vehicle (not shown). It will be understood that the present teachings are not limited to this exemplary use. Rather, the present teachings may be readily adapted for other applications, including but not limited to use with other combustion engines, such as stationary engines for power plants and the like.

The air filter housing 14 may define a resonance chamber 22 and may include an inlet 24 in fluid communication with the environment (e.g., a source of intake air) and an outlet 26 in fluid communication with the duct 18. The filter 16 may be disposed between the inlet 24 and the outlet 26. The filter 16 may conventionally filter or clean the air as it travels through the housing 14 from the environment to the duct 18. The duct 18 includes a first end 28 and a second end 30. The first end 28 may communicate with the outlet 26 of the housing 14 and thereby the resonance chamber 22 of the air filter housing 14. The second end 30 of the duct 20 may be secured in fluid communication with the engine 13 in any manner well known in the art.

With continued reference to FIG. 1 and additional reference to FIGS. 2 through 5, the resonator 10 of the present disclosure will be further described. As illustrated, the resonator 10 will be understood to be a Helmholz-type resonator. In this regard, air passing through the duct 18 crosses the input port 20 leading to resonator 10.

The resonator 10 may generally include a resonator housing 32 and a neck 34. The resonator housing 32 may be injection molded of plastic or formed of any other suitable material. In the embodiment illustrated, the housing 32 is illustrated to include a first shell portion or lower shell portion 32A and a second shell portion or upper shell portion 32B. The first and second shell portions 32A and 32B may be welded or otherwise secured to one another in any suitable manner. In alternative embodiments, the housing 32 may be constructed of a greater or lesser number of portions within the scope of the present teachings. The housing 32 may be integrally formed to include an outer portion or outer shell 36 of the neck 34.

The housing 32 may define a plurality of distinct resonance chambers. In the embodiment illustrated, the housing 32 may include first, second and third resonance chambers 38A, 38B and 38C. It will be understood that the housing 32 may include a greater or lesser number of resonance chambers 38A, 38B and 38C within the scope of the present teachings. In the embodiment illustrated, the first resonance chamber 38A has a first volume which is greater than a second volume of the second chamber 38B. The second volume may be greater than a third volume of the third chamber 38C.

Figure 3:
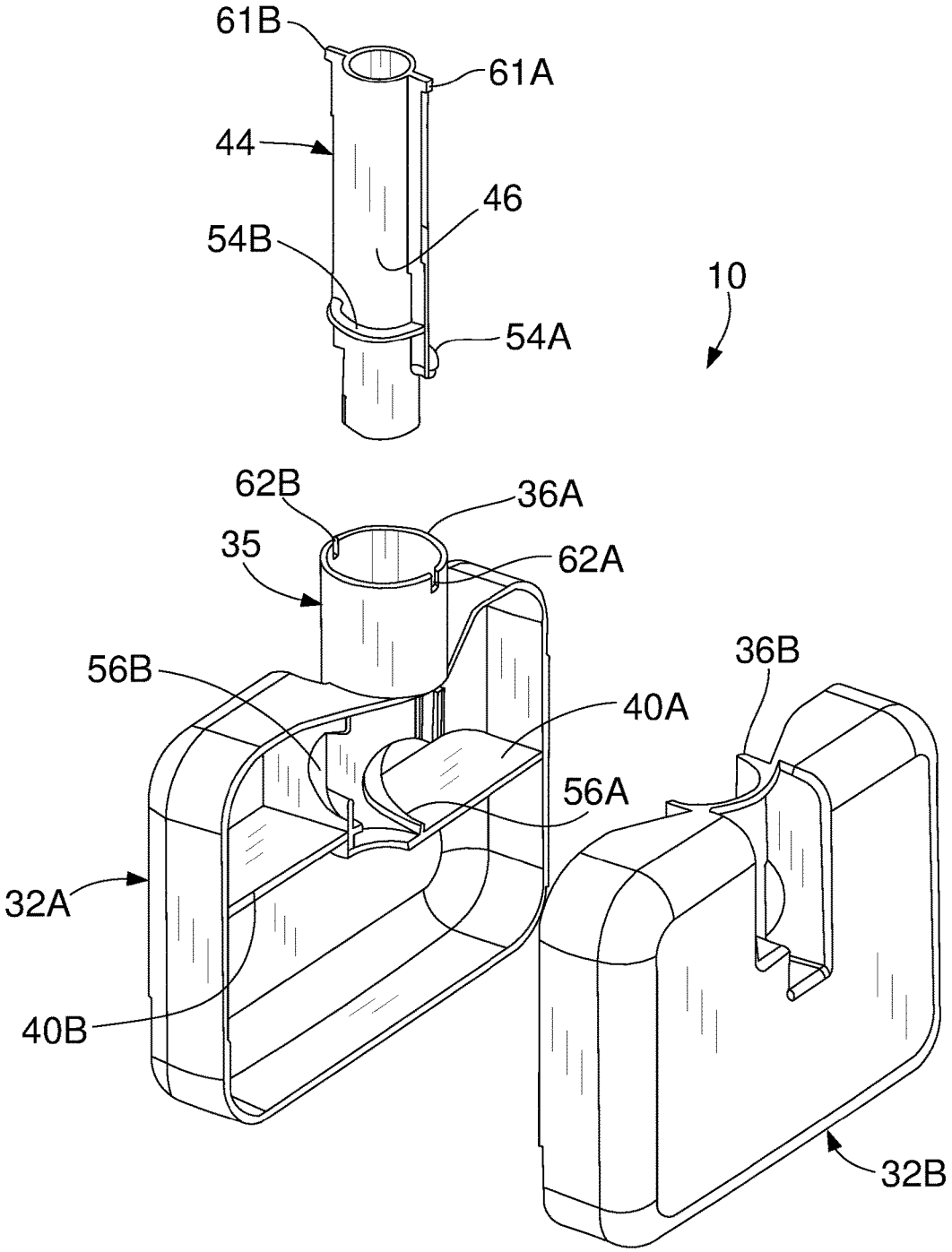
FIG. 3 is an exploded view of a resonator in accordance with the present teachings.

The resonance chambers 38A-C of the housing 32 may be cooperatively defined by the first and second shell portions 32A and 32B. In this regard, the first and second shell portions 32A and 32B may be formed to include internal shelves. FIGS. 3 and 4 illustrate the shelves of the first shell portion 32A. It will be understood that the second shell portion 32B is formed to include similar shelves. As shown, a first shelf 40A may separate the first chamber 38A from the second chamber 38B and a second shelf 40B may separate the first chamber 38A from the third chamber 38C.

The outer portion 36 of the neck 34 may be tubular in shape and may be joined to the conduit 18 with clamps or by welding. In the embodiment illustrated, the outer portion 36 includes a distal portion 36A (e.g., proximate the conduit 18) defined by the first shell portion 32A and a proximal portion 36B cooperatively defined by the first and second shell portions 32A and 32B. The distal portion 36A may be tubular. The proximal portion 36B may be partially tubular.

The neck 34 may further include an inner partition 44. As will be appreciated more fully below, the partition 44 may cooperate with the outer shell portion 36 to define a corresponding plurality of distinct air paths between the air duct and the plurality of resonance chambers. The partition 44 may include a tube 46 defining an interior. The interior of the tube 46 may define a first air path 48A in fluid communication with the first resonance chamber 38A of the housing 32. In this regard, the tube 46 may extend into the first resonance chamber 38A and may be open at an end 50 thereof.

The partition 44 may further include first and second radially extending flanges 52A and 52B. The first and second radially extending flanges 52A and 52B may cooperate with the tube 46 and the outer shell 36 of the neck 34 to define second and third air paths 48B and 48C. The second and third air paths 48B and 48C are radially disposed between the tube 46 and the outer shell 36.

The second air path 48B extends from the conduit 18 to the second resonance chamber 38B. The partition 44 further includes a first radially extending lip 54A that cooperates with the shelf 40A to close an end of the second air path 48B. The outer shell 36 defines a first radially extending path opening 56A into the second resonance chamber 38B. The partition 44 still further includes a second radially extending lip 54B that cooperates with the shelf 40B to close an end of the third air path 48C. The outer shell 36 defines a second radially extending opening 56B into the third resonance chamber 38C. The tube 46 may include one or more locating pins or projections 61A, 61B that may advantageously be formed on one or more of the radially extending flanges 52A and 52B. The locating pins or projections 61A, 61B engage into corresponding grooves 62A, 62B formed into the axial end of the neck 34, thereby axially fixing the position of the tube 46 in the interior of the neck 34 while also rotationally fixing the rotational position of the tube 46 in the interior of the neck 34.

Operation of the air induction system 12 including the resonator 10 of the present teachings will now be described in more detail. The engine 13 will produce sound waves at various frequencies. For example, dominant frequencies may correspond to peak revolutions-per-minute prior to gear shifting. During operation of the engine 13, air travels along the duct 18 in a first direction A (see FIG. 1). Sound waves from the engine 13 noise travel along the duct 20 in an opposite direction B.

The resonator 10 of the present teachings is particularly adapted to attenuate three distinct frequencies. These distinct frequencies may be tuned by adjusting dimensions of the resonator 10. Explaining further, dimensions such as the inside diameter of the outer shell 36, the inside diameter of the tube 44, the length of the air paths 48A-48C and the volume of the resonance chambers 38A-38C may be adapted to attenuate first, second, and third frequency peaks.

Accordingly, the present teachings provide a resonator design utilizing a single port 20 from a clean side duct 18 that is partitioned into multiple individually dimensioned air passages 48A-48C leading to corresponding volumes 38A-38C within a resonator housing 32. Through the present teachings, multiple ports may be eliminated to reduce packaging constraints and tooling issues. While the present teachings are particularly adapted for an air induction system 12, it will be understood that the resonator 10 may also be used with an exhaust system.

The foregoing description is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A resonator for attenuating sound waves produced by an engine, the resonator comprising:

a resonator housing including a plurality of resonance chambers in an interior of the resonator housing; and a tubular neck having an outer shell radially surrounding plurality of distinct air paths within an interior of the outer shell, the tubular neck extending from the resonator housing outwardly to a first end for providing fluid communication between the resonator housing and an air duct, the tubular neck further including a tubular partition disposed radially within the interior of the outer shell, the tubular partition cooperating with the outer shell to define a plurality of distinct air paths extending between the first end and of the outer shell to respective ones of the plurality of resonance chambers, each air path in fluid communication with a distinct resonance chamber of the plurality of resonance chambers, wherein the resonator is operable to attenuate sound waves produced by the engine, wherein the tubular partition radially encloses and defines a first air path of the plurality of distinct air paths within an interior of the tubular partition, the first air path opening at a first end of the tubular partition to communicate with the air duct, the first air path opening at an opposite second end of the tubular partition into a first resonance chamber of the plurality of resonance chambers, wherein a second air path of the plurality of distinct air paths is arranged radially between an outer surface of the tubular partition and an inner surface of the tubular neck, the second air path opening at a first end to communicate with the air duct, the second air path opening within the resonator housing into a second resonance chamber of the plurality of resonance chambers.

2. The resonator of claim 1, wherein the resonator is adapted to attenuate sound waves produced by the engine having at least two unwanted frequencies.

3. The resonator of claim 1, wherein the resonator is adapted to attenuate sound waves produced by the engine having three unwanted frequencies.

4. The resonator of claim 1, wherein the tubular partition is concentrically positioned relative to the tubular outer shell of the neck.

5. The resonator of claim 1, wherein the tubular partition further includes first and second radially extending flanges each extending radially outward from the outer surface of the tubular partition outwards to the inner surface of the tubular neck partitioning a radial space between the outer surface of the tubular partition and the inner surface of the tubular neck into the second air path.

6. An air induction system for attenuating sound waves produced by an engine, the air induction system comprising:

an air duct for transmitting a source of intake air to an engine;

a resonator housing including a plurality of resonance chambers in an interior of the resonator housing;

a tubular neck defining a corresponding plurality of distinct air paths connecting the air duct and respective ones of the plurality of resonance chambers, the tubular neck radially surrounding plurality of distinct air paths within an interior of the tubular neck, the plurality of distinct air paths extending from the resonator housing outwardly to communicate with the air duct; and a tubular partition disposed radially within the interior of the tubular neck, the tubular partition cooperating with the tubular neck to define a plurality of distinct air paths extending between the first end and of the outer shell to respective ones of the plurality of resonance chambers, each air path in fluid communication with a distinct resonance chamber of the plurality of resonance chambers, wherein the resonator is operable to attenuate sound waves produced by the engine, wherein the tubular partition radially encloses and defines a first air path of the plurality of distinct air paths within an interior of the tubular partition, the first air path opening at a first end of the tubular partition to communicate with the air duct, the first air path opening at an opposite second end of the tubular partition into a first resonance chamber of the plurality of resonance chambers, wherein a second air path of the plurality of distinct air paths is arranged radially between an outer surface of the tubular partition and an inner surface of the tubular neck, the second air path opening at a first end to communicate with the air duct, the second air path opening within the resonator housing into a second resonance chamber of the plurality of resonance chambers.

7. The air induction system of claim 6, wherein the tubular neck is unitarily formed in one piece with a portion of the resonator housing.

8. The air induction system of claim 6, wherein the tubular partition is concentrically arranged relative to the tubular neck.

9. The resonator of claim 5, wherein the second air path is radially enclosed in combination by the first and second radially extending flanges, the outer surface of the tubular partition and the inner surface of the tubular neck, wherein a third air path of the plurality of distinct air paths is arranged radially between the outer surface of the tubular partition and the inner surface of the tubular neck and separated from the second air path by at least one of the radially extending flanges.

10. The air induction system of claim 6, wherein the tubular partition further includes first and second radially extending flanges each extending radially outward from the outer surface of the tubular partition outwards to the inner surface of the tubular neck partitioning a radial space between the outer surface of the tubular partition and the inner surface of the tubular neck into the second air path.

11. The air induction system of claim 10, wherein the second air path is radially enclosed in combination by the first and second radially extending flanges, the outer surface of the tubular partition and the inner surface of the tubular neck, wherein a third air path of the plurality of distinct air paths is arranged radially between the outer surface of the tubular partition and the inner surface of the tubular neck and separated from the second air path by at least one of the radially extending flanges.

12. The air induction system of claim 11, wherein the first air path has a first length, the second air path has a second length and the third air path has a third length, the first length being greater than or equal to the second length, the second length being greater than or equal to the third length.

13. The air induction system of claim 11, wherein the first chamber has a first volume, the second chamber has a second volume and the third chamber has a third volume, the first volume being greater than or equal to the second volume, the second volume being greater than or equal to the third volume.

* * * * *